United States Patent [19]

Hopfensperger

[11] Patent Number: 4,761,115

[45] Date of Patent: Aug. 2, 1988

[54] AXIAL-FLOW FAN

[75] Inventor: Reinhold Hopfensperger, Dietelskirchen, Fed. Rep. of Germany

[73] Assignee: Standard Elektrik Lorenz AG, Stuttgart, Fed. Rep. of Germany

[21] Appl. No.: 942,735

[22] Filed: Dec. 17, 1986

[30] Foreign Application Priority Data

Mar. 19, 1986 [DE] Fed. Rep. of Germany ..... 3609212

[51] Int. Cl.[4] ..... F04D 29/54

[52] U.S. Cl. ..... 415/119; 415/DIG. 1; 415/192

[58] Field of Search ..... 415/119, DIG. 1, 213 C, 415/121 G, 192, 183, 185, 191, 195; 416/236 A

[56] References Cited

U.S. PATENT DOCUMENTS

| | | | |
|---|---|---|---|
| 2,142,307 | 1/1939 | De Mey et al. | 415/119 X |
| 3,362,627 | 1/1968 | Pabst | 415/213 C X |
| 4,089,618 | 5/1978 | Patel | 416/236 A X |
| 4,482,302 | 11/1984 | Grignon | 415/213 C X |

FOREIGN PATENT DOCUMENTS

| | | | |
|---|---|---|---|
| 0111443 | 11/1983 | European Pat. Off. . | |
| 2414695 | 10/1975 | Fed. Rep. of Germany | 415/119 |
| 2618894 | 11/1977 | Fed. Rep. of Germany | 415/119 |
| 2529541 | 3/1980 | Fed. Rep. of Germany . | |
| 3234011 | 3/1984 | Fed. Rep. of Germany . | |
| 55-112899 | 9/1980 | Japan | 415/213 C |
| 441269 | 1/1936 | United Kingdom | 415/213 C |
| 983469 | 2/1965 | United Kingdom | 415/119 |

*Primary Examiner*—Robert E. Garrett
*Assistant Examiner*—Joseph M. Pitko
*Attorney, Agent, or Firm*—Spencer & Frank

[57] ABSTRACT

A frame-supported fan in which the mounting portions between the motor and the frame are formed in the shape of an arrowhead and/or are provided with sculptured edges extending to the frame or are provided with interfering bodies mounted to the outer ends of the edges of the frame, so as to reduce unwanted noise by producing non-uniform flow separation in the air stream through the fan.

11 Claims, 2 Drawing Sheets

AXIAL-FLOW FAN

FIELD OF THE INVENTION

The invention relates to an axial-flow fan whose blades are rotatably mounted within a frame and are driven by an electric motor attached to the frame by mounting portions.

BACKGROUND OF THE INVENTION

An axial-flow fan of a prior design is shown in German Patent De-Al No. 25 51 615.

An axial-flow fan mounted within a frame requires a connecting link or links between the outside frame, which surrounds the impeller, and the drive motor, which is mounted at the center. This connecting link, hereinafter called "mounting portion," provides a central mounting of the drive motor; and also provides support for the electric leads or wires connecting to the electric motor.

Aerodynamically, these mounting portions present an air flow resistance which causes both a loss of flow efficiency and additional noise. Therefore, the cross section of these members is kept as small as possible. However, since they are usually located very close to the blades (inlet or outlet side), the flow velocities are relatively high in this area. As the blades pass by, they produce a sound (interfering body near the blade) whose frequency, sound pressure and bandwidth (frequency bandwidth) are determined mainly by the number of blades, fan speed, blade geometry, shape and position of the mounting portions, number of the mounting portions, and distance between mounting portion and blade.

SUMMARY OF THE INVENTION

It is an object of the invention to provide an axial-flow fan of the above kind which does not produce a siren-like noise in operation, or in which such noise is largely suppressed without impairing the other operating characteristics of the fan.

In accordance with the invention, this object is achieved by the provision of fan motor mounting portions or struts having the shape of an arrowhead (generally V-shaped in a plane parallel to the plane of rotation of the blades) pointing in the circumferential direction opposite the circumferential direction of rotation of the fan blades.

Because of the shape of the mounting portions used in the invention, a guiding effect is produced on the strongly twisted outlet airstream of the axial-flow fan, e.g., the airstream is separated, with the result that the siren-like noise is largely suppressed or completely eliminated. Compared to the known curved mounting portions, the mounting portion used in the invention presents less resistance to the entire airstream, so that in a comparison measurement, an about 5% higher volume flow rate was determined.

DESCRIPTION OF THE PREFERRED EMBODIMENTS

Figure 1:
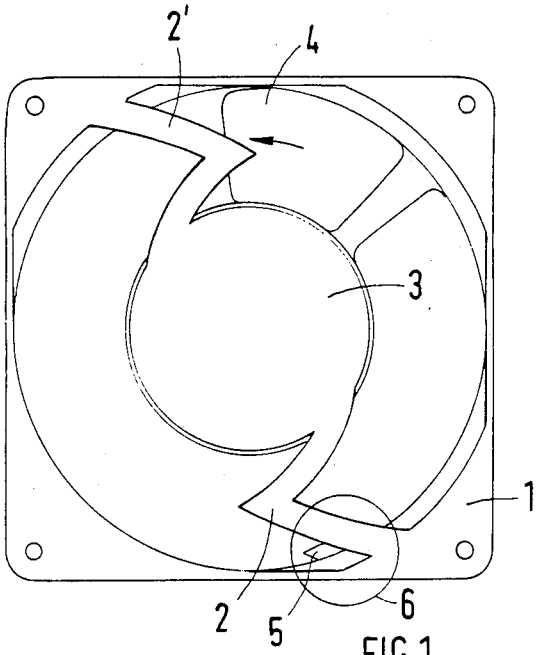
FIG. 1 is a top view of an axial-flow fan having mounting portions in accordance with the invention.

Referring first to FIG. 1, the axial-flow fan has a frame 1 which supports a motor-mounting device 3 via mounting portions 2 and 2'. On the motor-mounting device 3, an electric motor (not shown) is mounted to whose rotor an impeller is attached. The blades 4 of this impeller are designed so as to be located in the open space between the frame 1 and the motor-mounting device 3. For the sake of clarity, only one of the blades 4 is shown in FIG. 1. When operated, the blades 4 rotate in a counter-clockwise direction in the fan shown in FIG. 1. The mounting portions 2 and 2' have the shape of an arrowhead and have tips pointing in the clockwise direction, that is, in the circumferential direction opposite the circumferential direction of rotation of the fan blades 4.

Another detail of the invention is shown in the encircled area 6 of FIG. 1, i.e., an interfering body 5 which is located at the end of the mounting portion 2 which is next to the frame. This interfering body 5 forms in effect a circumferentially widened part of the mounting portion 2 at the intersection of the mounting portion 2 and the frame 1 and has the shape of a step extending in the circumferential direction. Such an interfering body is to be located at every mounting portion 2 in order to produce a flow separation in the strongly twisted outlet airstream of the axial flow fan, and it has an advantageous effect on the noise level of the axial-flow fan even if the mounting portions have a shape other than that shown in FIG. 1.

Figure 2:
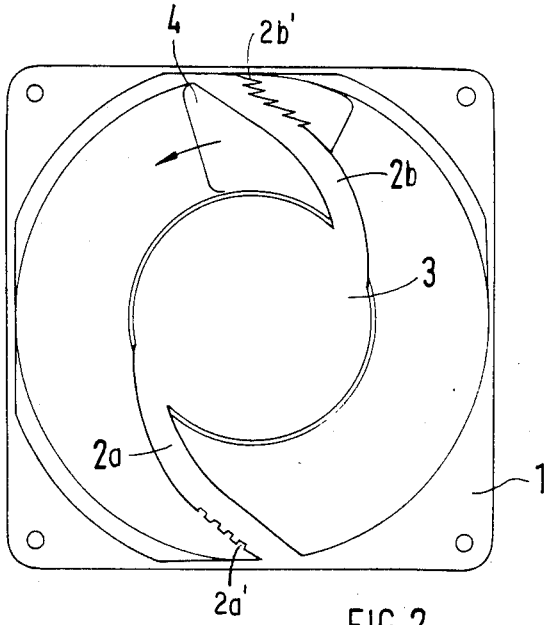
FIGS. 2, 3 and 4 are top views of axial-flow fans at whose mounting portions other noise-reducing measures have been taken.
Figure 3:
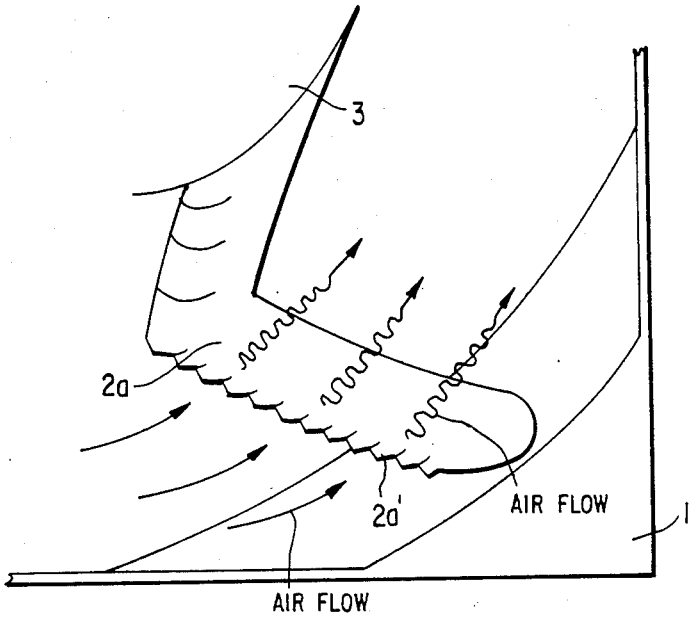
Figure 4:
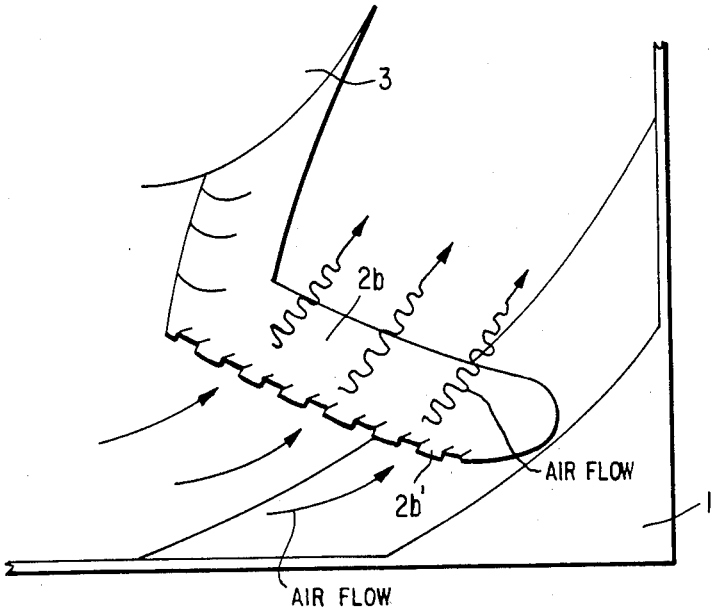

FIGS. 2, 3 and 4 illustrate another advantageous detail of the invention, i.e., the sculptured edge or face of the mounting portions on the suction side. On the upper mounting portion **2*b* in FIG. 2 and on mounting portions 2*b* in FIG. 3 (only one of two mounting portions shown in FIG. 3), the texture is sawtooth-shaped; on the lower mounting portion, 2*a* in FIG. 2 and on mounting portions 2*a*, in FIG. 4 only one of two mounting portions shown in FIG. 4), the texture is stepped. In FIG. 2, the mounting portions 2*a* and 2*b* curve radially outward. The embodiments illustrated in FIGS. 3 and 4 combine these features with the arrowhead-shaped mounting portions illustrated in FIG. 1**.

At the outer circumference of the impeller, the speed profile of the air delivered by the axial-flow fan shows a higher speed at the outer circumference or meridian, which is generally caused by higher air speeds at the periphery of the fan blades 4. The cause for the noise is thus to be found in the transition area between the mounting portions (**2*a* and 2*b*) and the frame 1. By shaping the mounting portions and their outer ends (2*a'* and 2*b'*, respectively) as described above, the noise is suppressed or at least largely reduced by a non-uniform flow separation. The effect of the sawtooth-shaped or stepped surface is produced even if the mounting portions do not have the shape shown in FIG. 1**. The invention can be used in axial-flow fans in whch the mounting portions are located on either the pressure or the suction side of the fan.

What is claimed is:

1. An axial flow fan comprising:

a frame having a central opening therein;

fan blades rotatably mounted for rotation in a plane within said frame central opening to produce an airstream through said fan;

an electric motor coupled to said blades to rotate said blades and positioned inside said central opening; and arrowhead-shaped mounting portions connecting said frame and said electric motor to attach said motor to said frame, each of said mounting portions being V-shaped in a plane parallel to the plane of rotation of said blades and having a tip between said frame and said motor, said mounting portions being oriented so that the tips point point in a circumferential direction relative to the center of rotation of said blades;

whereby said mounting portions guide the airstream through the fan and produce an air flow separation so that the generation of siren-like noise by the fan is suppressed.

2. The axial flow fan of claim 1 wherein said mounting portions have edges, said edges have outer ends extending to said frame, and wherein said edges are sculptured in areas near said outer ends to reduce the generation of noise by producing non-uniform flow separation in the airstream.

3. The axial flow fan of claim 2 wherein the sculptured edges have a sawtooth-shaped texture.

4. The axial flow fan of claim 2 wherein the sculptured edges have a stepped surface structure.

5. The axial flow fan of claim 1, further comprising an interfering body, said mounting portions have outer ends extending to said frame, said interfering body being mounted to the outer end of one of said mounting portions to limit the noise level produced by the fan.

6. The axial flow fan of claim 5 wherein said interfering body has the shape of a step extending in the circumferential direction.

7. An axial flow fan, comprising:

a frame having a central opening therein:

fan blades rotatably mounted within said frames central opening to produce an airstream through said fan;

an electric motor coupled to said blades to rotate said blades in a rotational direction and positioned inside said central opening; and mounting portions connecting said frame and said electric motor to attach said motor to said frame, said mounting portions having edges, said edges having outer ends extending to said frame, said edges facing in a circumferential direction opposite to said rotational direction and being sculptured in areas near said outer ends to reduce the generation of noise by producing non-uniform flow separation in the airstream.

8. An axial flow fan as in claim 7, wherein the sculptured edges have a sawtooth-shaped texture.

9. An axial flow fan as in claim 7, wherein the sculptured edges have a stepped surface structure.

10. An axial flow fan, comprising:

a frame having a central opening therein:

fan blades rotatably mounted within said frame central opening to produce an airstream through said fan;

an electric motor coupled to said blades to rotate said blades in a rotational direction and positioned inside said central opening;

mounting portions connecting said frame and said electric motor to attach said motor to said frame, said mounting portions having outer ends extending to said frame, said outer ends having front edges, said front edges facing in a circumferential direction opposite to said rotational direction; and interfering bodies mounted to said outer ends at said front edges so as to effectively widen said outer ends in said circumferential direction thereby to produce a non-uniform flow separation in the airstream which reduces the generation of noise.

11. An axial flow fan as in claim 10, wherein said interfering body has the shape of a step extending in said circumferential direction.

* * * * *